United States Patent [19]

Williams

[11] 3,999,380

[45] Dec. 28, 1976

[54] SUBLIMING SOLIDS GAS GENERATOR WITH CHEMICAL REACTION AUGMENTATION

[75] Inventor: Laurence O. Williams, Littleton, Colo.

[73] Assignee: Martin Marietta Corporation, Denver, Colo.

[22] Filed: Apr. 27, 1970

[21] Appl. No.: 29,767

Related U.S. Application Data

[63] Continuation of Ser. No. 677,093, Oct. 23, 1967, abandoned.

[52] U.S. Cl. ..... 60/218; 60/39.46 M; 60/200 R

[51] Int. Cl.[2] ..... C06D 5/04

[58] Field of Search ..... 60/200, 204, 253, 254, 60/39.82, 218, 39.46 M; 149/35, 36; 23/281; 252/372

[56] References Cited

UNITED STATES PATENTS

| | | | |
|---|---|---|---|
| 2,816,419 | 12/1957 | Mueller | 60/39.48 |
| 3,066,479 | 12/1962 | Koch, Jr. | 149/36 |
| 3,159,967 | 12/1964 | Webb | 60/202 |
| 3,230,705 | 1/1966 | Peterson | 60/204 |
| 3,298,182 | 1/1967 | Webb | 60/218 |
| 3,373,563 | 3/1968 | McCabe | 60/203 |
| 3,469,947 | 9/1969 | Drury | 252/372 |

*Primary Examiner*—Samuel Feinberg
*Attorney, Agent, or Firm*—Phillip L. DeArment; Gay Chin

[57] ABSTRACT

A gas generator producing usable power from a solid reactant which is sublimed as required to produce vapors and the vapors are chemically reacted to release stored energy and convert same to useful work.

21 Claims, 4 Drawing Figures

INVENTOR.

BY LAURENCE O. WILLIAMS

Anderson, Spangler + Wymore

INVENTOR.

BY LAURENCE O. WILLIAMS
Anderson, Spangler + Wegmore

SUBLIMING SOLIDS GAS GENERATOR WITH CHEMICAL REACTION AUGMENTATION

This is a continuation of application Ser. No. 677,093, filed Oct. 23, 1967, abandoned.

Subliming solids gas generators have as one interesting use the propulsion of rocket motors. Subliming solid rocket motors are of considerable interest for use in space systems because of the potential high reliability which results from their total or substantial lack of moving parts, and the absence of zero gravity liquid management problems. The development and application of subliming fuel rocket motors has been hindered in the past, however, due to their low performance. This has resulted from the available fuels having low specific impulse characteristics and high power input requirements to convert the fuel from the solid to gaseous state. Also, the exhaust products from the gas generator tended to deposit in the exhaust channel to further reduce the overall efficiency.

When rocket motors are used in the attitude control systems of spacecraft and satellites, they are not required to have a large amount of thrust to perform the task of performing relatively small movement maneuvers in a space environment. The low thrust requirement could be satisfied by the use of small motors based on the sublimation of solids under the influence of heat within the confines of an enclosed space and passing the gases exhausting therefrom through a nozzle or other energy conversion device to a lower energy level to produce useful work. It is desirable to have a minimum power input requirement to generate the vapors from the solid.

It is an object of this invention to provide a subliming solids gas generator which avoids one or more of the disadvantages of the prior art arrangements and has increased efficiency.

It is another object of this invention to provide a subliming solids rocket motor having a family of fuels wherein the vapor products of sublimation are chemically reactive to provide the release of additional useful energy.

It is a further object of this invention to provide a rocket motor wherein the fuel is solid and has a substantially infinite storage life.

It is still a further object of this invention to provide a subliming solids rocket motor wherein the recondensation of the solid fuel after vaporization is virtually eliminated.

A further object of the present invention is to provide a rocket motor which is not complicated, easy to operate, relatively inexpensive to manufacture and highly efficient.

In accordance with the invention, the subliming solids gas generator comprises a chamber having an outlet conduit, a single mass of solid fuel contained within said chamber which fuel is adapted to sublime with the application of heat, means for applying heat to the fuel, means positioned in the outlet conduit adapted to effect the catalytic decomposition of the sublimation products of the fuel as these products are exhausted from the chamber through the outlet conduit with the decomposition of the products being an exothermic reaction. The invention further contemplates an energy conversion device such as a rocket nozzle, gas turbine and the like connected to receive the gases issuing from the chamber outlet to convert the energy stored therein to useful work. The invention further contemplates the provision of means to produce sublimation and catalytic conversion of the fuel on demand.

For a better understanding of the present invention, together with other and further objects thereof, reference is had to the following description taken in connection with the accompanying drawing and its scope will be pointed out in the appended claims.

Referring to the drawings.

The fuels utilized in sublimed solids rocket motors need only be a solid with a sublimation vapor pressure which is reasonably high under feasible temperatures. The performance of these rockets is nevertheless governed by the same parameters as any other rocket. The specific impulse (Isp) is given by:

$$Isp = K\,(T/M)^{1/2} \qquad (1)$$

where $K$ is a constant $T$ is the temperature and $M$ is the molecular weight of the exhaust gas.

In these rocket motors, the temperature of the exhaust gases is limited by the heat input energy and the molecular weight is determined by the fuel selected. In practice, fuel specific impulses ranging from about 20 to about 50 seconds are obtained using ammonium carbonate, ammonium hydrosulfide, and the like, as fuels. Where a fuel is used which, in addition to providing an energy output from the fuel sublimation, provides additional energy produced by a heat producing chemical decomposition or reaction, there is found to be a 5 to 10 fold increase in the performance of the rocket motors for the same level of simplicity and reliability.

Figure 1:
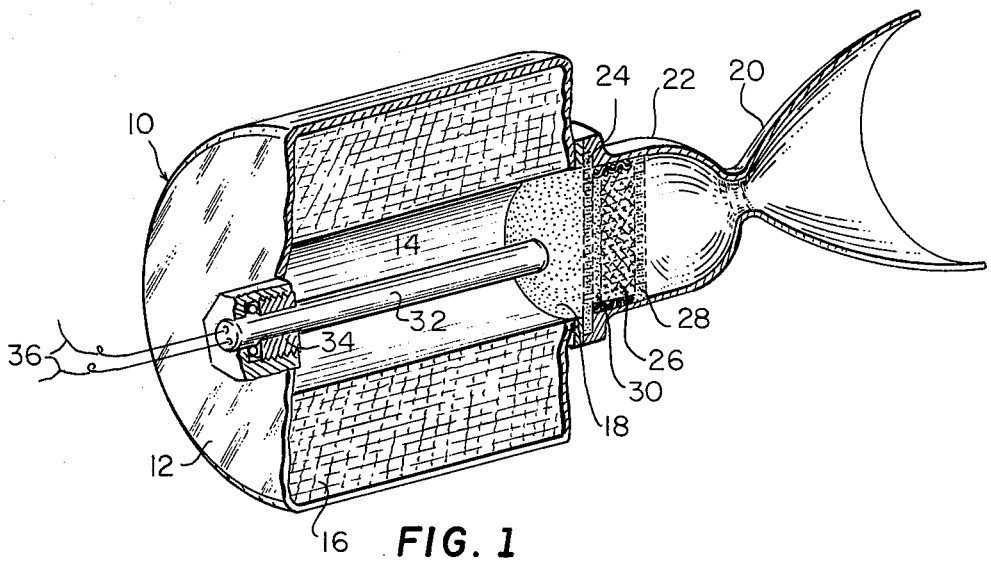
FIG. 1 is an isometric cross sectional view of one embodiment of the gas generator of this invention including a rocket nozzle connected thereto.

FIG. 1 illustrates one form which the rocket motors embodying the present invention may take. The rocket motor 10 is seen to include a fuel chamber 12 of cylindrical or other suitable configuration enclosing a space 14 containing a block of fuel 16 which is a single mass and may be of annular cross section to leave space 14 unfilled centrally of chamber 12. Chamber 12 has an axially positioned opening 18 through one end thereof. Attached to chamber 12 by suitable means in substantial axial alignment with opening 18 in chamber 12 is a rocket nozzle 20 provided with an upstream housing 22 with said housing being connected directly to the chamber 12 and communicating therewith through opening 18. A porous barrier 24 is positioned within housing 22 to be across opening 18. Barrier 24 is for the purpose of preventing recirculation of gaseous products returning to the fuel chamber after egress therefrom. Barrier 24 can be fabricated from porous ceramic or other suitable materials and should offer a minimum resistance to gas flow consistent with preventing back flow.

Downstream of barrier 24 and adjacent thereto is positioned a catalytic mass 26 also quite porous to offer a minimum of resistance to gas flow therethrough. The catalyst 26 should have a minimum mass since energy used to heat the catalyst is lost to the propulsion cycle. The catalyst may advantageously be in the form of an open mat of very fine wire either self-supporting or supported by a screen 28 and 30 on each side. Screen 30 positioned between the catalyst 26 and barrier 24 is preferably heat insulating or spaced from barrier to insulate against heat being transferred from the catalyst 26 to the fuel 16 which would render the gas evolution unstable.

An electric heater 32 of the shielded quartz type such as the Glo-Quartz heater available from Aloe Scientific, model number V49485, is axially positioned in cylindrical chamber 12. Heater 32 is seen to pass through the end of chamber 12 opposite opening 18 and is supported in gastight relation by means of a packing and nut 34. The leads 36 of heater 32 are connected to a suitable source of electrical power, not shown.

One fuel which is found to be suitable for use in the rocket motor shown in FIG. 1 is ammonium azide, $NH_4N_3$. Ammonium azide is a solid with a high vapor pressure which is vaporized with heat. When the vapor is passed through a suitable catalyst, it will exothermally decompose to produce a high temperature, low molecular weight working fluid. This fluid may be expanded through a nozzle or turbine in a conventional manner to produce work such as thrust. Ammonium azide has a melting point of 160° C and the heat of formation (solid) is +27K Cal/Mole.

The heat of sublimation of ammonium azide calculated from existing vapor pressure data yields a heat of vaporization of 14.2 K Cal/Mole or 236 Cal/g. Conversion of this value to its electrical equivalent and using a vacuum specific impulse of 245.7 yields a thrust power performance of 0.541 lbs/KW.

$$\frac{\text{lbs Thrust}}{\text{Kwt}} = \tag{2}$$

$$\left(\frac{1000\ \text{Watts}}{\text{Kwt}}\right)\left(\frac{1\ \text{Joule}}{\text{Watt}}\right)\left(\frac{1\ \text{Cal}}{4.184\ \text{Joule}}\right)\left(\frac{1\ \text{gm}\ NH_4N_3}{239\ \text{Cal}}\right)\left(\frac{245.7\ \text{lb/sec}}{\text{lb}}\right)\left(\frac{.0022046\ \text{lb}}{\text{gm}}\right)$$

$$= \frac{1000 \times 245.7 \times .0022046}{4.184 \times 239}$$

$$= 0.541\ \text{lbs/Kwt}$$

For subliming rockets utilizing ammonium hydrosulfide, the heat of vaporization of the solid is approximately the same as for ammonium azide, but the specific impulse is only one-tenth as much or about 25 sec. Therefore, the thrust power relationship using ammonium hydrosulfide is only about 0.05 lbs/Kwt.

The ammonium azide vapor probably exists both as a molecule and dissociated ammonia and hydrazoic acid.

$$XNH_4N_{3(solid)} \xrightarrow{heat} YNH_4N_{3(gas)} + X - Y(NH_{3(gas)} + HN_{3(gas)}) \tag{3}$$

Due to the high positive heat of formation of the gas, +41 K Cal/Mole (calculated), it can be catalytically decomposed to high temperature hydrogen, nitrogen and ammonia. Catalysis of this reaction requires a material capable of activation of nitrogen, hydrogen or both. Suitable catalysts appear to be ruthenium, iron, cobalt, nickel, rhenium, rhodium and platinum with ruthenium being preferred and iron next, being less costly than ruthenium.

Several compounds in addition to ammonium azide appear to be suitable as a high energy solid fuel for a subliming rocket motor with chemical reaction augmentation. These include hydroxylamine ($NH_2OH$) with a vacuum specific impulse range of from about 270 sec. to about 290 sec.; hydroxylamine azide ($NH_3OHN_3$) with a vacuum specific impulse range of from about 270 sec. to about 290 sec.; hydrazine azide ($N_2H_5N_3$) with a vacuum specific impulse range of from about 260 sec. to about 280 sec.; hydrazine azide-hydrazinate ($N_7H_9$) with a vacuum specific impulse range of from about 260 sec. to about 290 sec.; and, azidoamine ($NH_2N_3$) with about the same vacuum specific impulse range. Thus it is seen that the above as well as any solid having a relatively high vapor pressure which is sublimed at relatively low temperatures by the application of heat into vapors capable of a catalytically induced exothermic reaction to produce a high temperature, relatively low molecular weight working fluid is a suitable fuel for the gas generators of this invention.

Referring again to FIG. 1, in operation electrical power is selectively applied to leads 36 from a suitable electrical source, not shown, raising the temperature of heater 32. Heat is transmitted to solid fuel 16 causing a portion to sublime creating a positive gas pressure within chamber 12 in space 14. The gas flows out of chamber 12 through porous barrier 24 and insulation 30 into the catalyst bed 26 where it is decomposed with the release of heat to a high temperature gas mixture which is allowed to expand through nozzle 20 to produce thrust.

Figure 2:
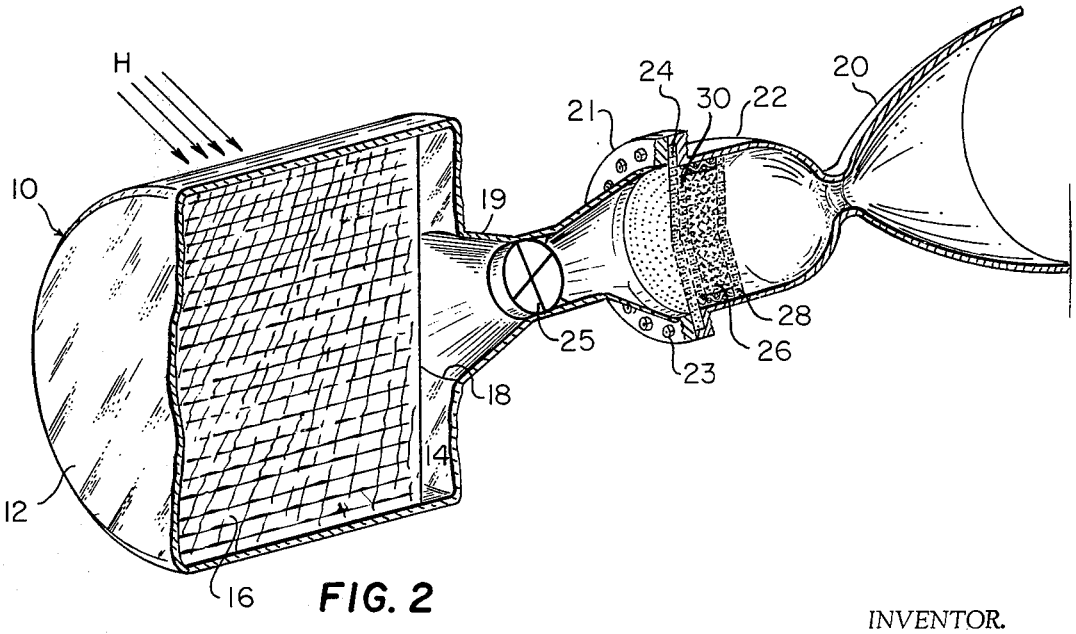
FIG. 2 is an isometric cross sectional view of another embodiment of a rocket motor utilizing the gas generator of this invention.

Referring now to FIG. 2, another embodiment of the present invention is shown in the form of a subliming solids rocket motor which makes use of external heating such as solar heating and the like. Again, the rocket motor is identified by the reference numeral 10. The motor 10 includes a chamber 12 defining a space 14 containing a selected solid fuel 16. Chamber 12 is provided with an opening 18 in one end thereof. A valve housing 19 is connected to chamber 12 in gas-tight relation and in registry with opening 18 by suitable means as by welding and the like, with the interior of the valve housing 19 communicating with the space 14 of chamber 12. The other end of the valve housing 19 is connected to and supports housing 22 of the rocket nozzle 20. Housing 19 is fastened to housing 22 in gas-tight relation as by means of a flange 21 and bolts 23. The valve housing 19 includes a valve 25 intermediate the ends thereof connected to chamber 12 and rocket housing 22 for selectively providing a path for egress of gas pressure built up in chamber 12 by the application of external heat H from a suitable source. When valve 25 is opened, gas flows therethrough from space 14. The gas passes through porous barrier 24 and insulation 30 into the catalyst 26 where it is decomposed with the release of heat to produce a high temperature gas mixture which is allowed to expand through nozzle 20 to produce thrust.

Figure 3:
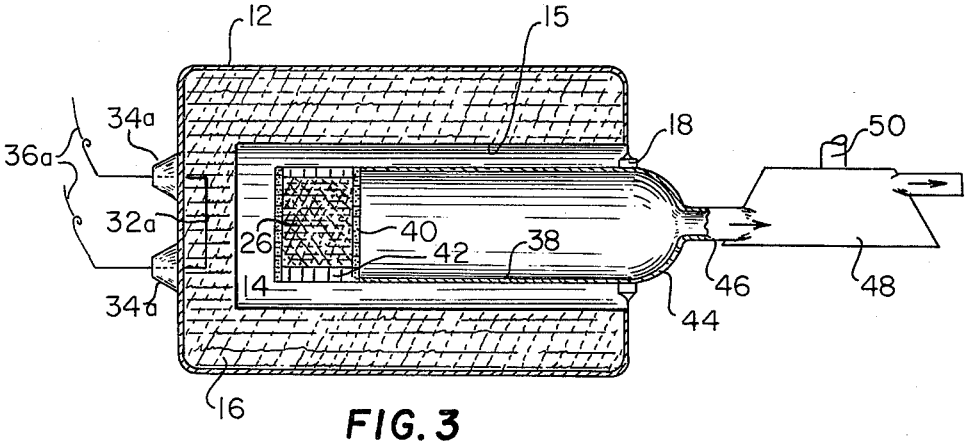
FIG. 3 is a plan view, partly in cross section, of another embodiment of the gas generator of this invention connected to a gas turbine; and, FIG. 4 is an isometric cross sectional view of still another embodiment of a rocket motor including a further embodiment of the gas generator of this invention.

FIG. 3 illustrates another embodiment of the present invention wherein a portion of the heat generated by the catalytic decomposition of the gaseous fuel is utilized to sublime additional solid fuel to sustain gas generation and decomposition. This embodiment might well be used in a continuous type operation where the high temperature gases are allowed to expand through an efficient gas turbine to provide rotary motion for the driving of an electric generator and the like. The gas generator is seen to comprise a chamber 12 enclosing a space 14 containing a selected fuel 16. The fuel 16 is in the form of a hollow cylinder having an axial cavity 15. Chamber 12 has an opening 18 in one end thereof substantially aligned with the cavity 15 of fuel 16. A heat exchange tube 38 is concentrically positioned to extend into the cavity 15 of fuel 16 and is sealed in gas-tight relation to chamber 12 in passing through opening 18 in a suitable manner. At the inner end of tube 38, a catalyst chamber 40 is provided with the catalyst 26 contained therein. The walls 42 of catalyst chamber 40 are porous to allow gases in space 14 to pass therethrough and through catalyst 26. In this embodiment, there is no need for insulating the heat generated in the catalytic decomposition from the solid fuel; however, it may still be desirable that walls 42 serve to avoid feedback of decomposition products into the fuel chamber. To initiate the gas generator, a heater 32*a* is embedded in fuel 16 having leads 36*a* connected thereto via insulators 34*a* in the wall of chamber 12 opposite the wall containing opening 18. Heater 32*a* may be an expendable heater serving only to start up the gas generator. Tube 38 is constructed of a material having good heat exchange properties. When heater 32*a* is energized by connection to a source of electrical power, not shown, the gases resulting from the sublimation of the solid fuel 16 pass through walls 42 of catalyst chamber 40 and are catalytically decomposed by catalyst 26 into high temperature gases. These hot gases pass into heat exchange tube 38 and a portion of the heat is radiated from the outer surface of tube 38 to the fuel 16 causing additional fuel to sublime to maintain the cycle. The outer end of heat exchange tube 38 is provided with a portion 44 of reduced diameter connected to conduit 46. Conduit 46 is connected to the inlet of a gas turbine 48. The high temperature gases issuing from conduit 46 drive the shaft 50 of turbine 48 which may be connected to drive an electric generator and the like or perform other useful work.

Figure 4:
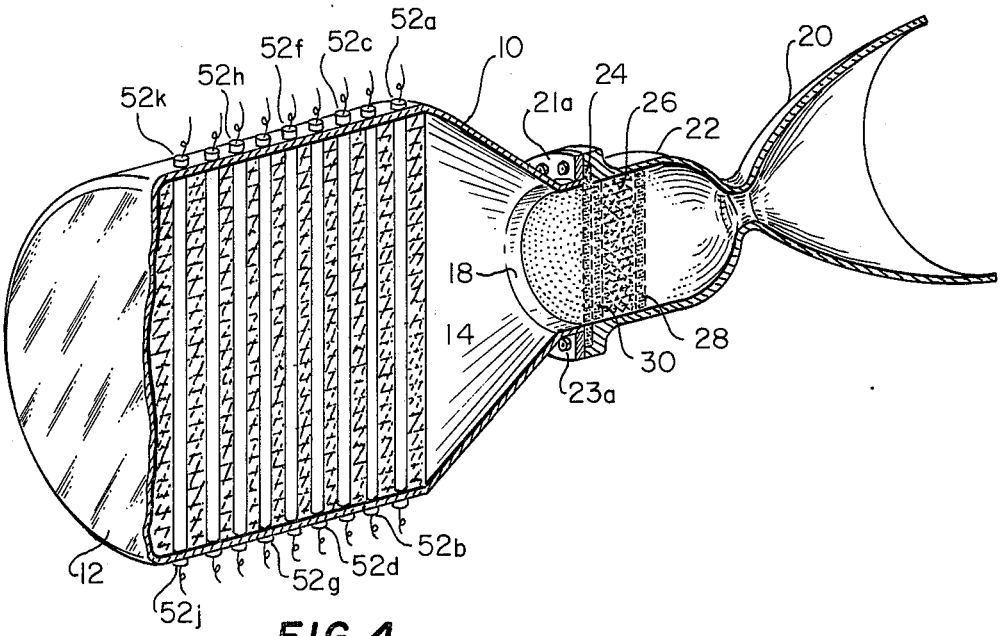

Referring now to FIG. 4, another embodiment of this invention is shown also in the form of a rocket motor 10. The motor 10 is seen to include a chamber 12 defining a space 14 having a selected fuel 16 contained therein. Again, chamber 12 is provided with an opening 18 in one end communicating space 14. Rocket nozzle housing 22 is attached to chamber 12 in a suitable manner in registry with opening 18. Housing 22 contains porous barrier 24, insulation 30, catalyst mat 26 and porous support 28 progressing from opening 18. Flange 21*a* is connected to chamber 12 as by welding and the like and is secured to housing 22 by means of bolts 23*a* clamping barrier 24 therebetween. A plurality of heaters 52*a, b, c, d, e, f, g, h, j, k*, are embedded in the fuel charge 16. These heaters are sequentially connected via electric leads on demand to a suitable source of electrical power, not shown, to sublime discrete portions of the solid fuel for conversion to a high temperature working fluid by the catalytic mat 26. These gases are then allowed to expand through nozzle 20 to produce thrust.

The upper limit of the operating temperature within chamber 12 is dictated by the melting point of the fuel selected. For example, ammonium azide has a melting point of 160° C, thus the preferred operating temperature in the fuel cell should be less than about 150° C to maintain the integrity of the shape of the fuel mass. A vapor pressure of 14.7 psi is produced at 133° C.

The preferred fuels are those which will sublime to provide a gaseous medium having relatively high vapor pressures at low temperatures which, on catalytic activation of the gases, will exothermally decompose to produce a high temperature, low molecular weight working fluid.

I claim:

1. A subliming solids gas generator which comprises: a gas-tight chamber having an outlet conduit, a single mass of solid fuel devoid of a liquid contained within said chamber which fuel has a positive heat of formation and is adapted to sublime with the application of heat to provide a gaseous medium having a relatively high latent chemical energy content due to the positive heat of formation, means for supplying heat to said fuel, catalyst means for effecting the catalytic decomposition of the gaseous medium on issuance thereof from said outlet conduit to release the latent chemical energy and provide a high temperature working fluid, and means connected to said outlet conduit to convert the high temperature working fluid to useful work.

2. A subliming solids gas generator according to claim 1 wherein the fuel chamber is separated from the catalyst means by a porous barrier to prevent gas backflow into said fuel chamber.

3. A subliming solids gas generator according to claim 1 wherein the fuel chamber is separated from the catalyst by a porous barrier and an insulation means to prevent the backflow of gases and heat into said fuel chamber.

4. A subliming solids gas generator according to claim 1 wherein the solid fuel is one wherein the combined thermal and reaction vacuum specific impulse is in excess of about 200 seconds.

5. A subliming solids gas generator according to claim 1 wherein the solid fuel sublimes and decomposes to provide at least high temperature hydrogen and nitrogen gases.

6. A subliming solids gas generator according to claim 1 wherein the fuel is selected from the group consisting of solid ammonium azide, hydroxylamine, hydroxylamine azide, hydrazine azide, hydrazine azide-hydrazinate and azidoamine.

7. A subliming solids gas generator according to claim 1 wherein the fuel is solid ammonium azide.

8. A subliming solids gas generator according to claim 1 wherein the catalyst means is a catalyst selected from the group consisting of ruthenium, iron, cobalt, nickel, rhenium, rhodium and platinum.

9. A subliming solids gas generator according to claim 1 wherein the means for supplying heat comprises an electric heater positioned within the gas-tight chamber.

10. A subliming solids gas generator according to claim 1 including valve means in said outlet conduit intermediate said fuel and said catalyst means to selectively control the discharge of gases from said gas-tight chamber.

11. A subliming solids gas generator according to claim 1 wherein the outlet conduit has a substantial portion thereof including the catalyst means positioned within said gas-tight chamber in heat exchange relation to said fuel.

12. A subliming solids gas generator according to claim 1 wherein the means for supplying heat to the fuel includes a plurality of heater elements embedded in the solid fuel and which an activation are each adapted to sublime a discrete portion of the fuel charge.

13. A subliming solids gas generator according to claim 1 wherein the solid fuel sublimes to provide a gaseous medium at relatively low temperatures.

14. A subliming solids gas generator in accordance with claim 6 wherein the catalyst means is a catalyst selected from the group consisting of ruthenium, iron, cobalt, nickel, rhenium, rhodium and platinum.

15. A subliming solids gas generator in accordance with claim 7 wherein the catalyst means is a catalyst selected from the group consisting of ruthenium, iron, cobalt, nickel, rhenium, rhodium and platinum.

16. A subliming solids gas generator according to claim 11 wherein the work conversion means includes a gas turbine.

17. The method of producing a high temperature working fluid from a solid fuel which comprises the steps of providing a single mass of solid fuel devoid of a liquid which has a positive heat of formation and is adapted to sublime with the application of heat to provide a gaseous medium having a relatively high latent chemical energy content due to the positive heat of formation, enclosing said solid fuel within a gas-tight chamber having an outlet, applying heat to said fuel in an amount sufficient only to produce a gaseous medium with a vapor pressure adequate to force the gases through a catalytic zone containing a catalyst adapted to decompose the gases to release the latent chemical energy and produce a high temperature working fluid, and expanding said working fluid through a work conversion means to produce work.

18. The method of claim 17 wherein the solids fuel is selected from the group consisting of solid ammonium azide, hydroxylamine, hydroxylamine azide, hydrazine azide, hydrazine azide-hydrazinate and azidoamine.

19. The method of claim 17 wherein the solid fuel is solid ammonium azide.

20. The method of claim 18 wherein the catalyst for decomposing the gaseous medium is selected from the group consisting of ruthenium, iron, cobalt, nickel, rhenium, rhodium and platinum.

21. The method of claim 19 wherein the catalyst for decomposing the gaseous medium is selected from the group consisting of ruthenium, iron, cobalt, nickel, rhenium, rhodium and platinum.

* * * * *